United States Patent [19]

Henzi et al.

[11] 3,933,602

[45] Jan. 20, 1976

[54] PALLADIUM ELECTROPLATING BATH, PROCESS, AND PREPARATION

[75] Inventors: Rene Henzi; Andre Meyer, both of Geneva, Switzerland; Pierre Lalanne, Gex, France

[73] Assignee: Oxy Metal Industries Corporation, Detroit, Mich.

[22] Filed: Apr. 19, 1974

[21] Appl. No.: 462,484

[30] Foreign Application Priority Data

Apr. 27, 1973 Switzerland ..... 6142/73

[52] U.S. Cl. ..... 204/44; 204/43 N; 204/47; 423/22; 423/351; 423/512

[51] Int. Cl.[2].... C25D 3/50; C25D 3/52; C25D 3/56

[58] Field of Search..... 204/47, 43 N, 44

[56] References Cited

UNITED STATES PATENTS

| | | | |
|---|---|---|---|
| 1,921,941 | 8/1933 | Powell et al. | 204/47 |
| 2,452,308 | 10/1948 | Lambros | 204/47 |
| 3,150,065 | 9/1964 | Fatzer | 204/47 |
| 3,458,409 | 7/1969 | Hayashi et al. | 204/43 N |
| 3,544,435 | 12/1970 | Angus et al. | 204/47 |
| 3,637,474 | 1/1972 | Zuntini et al. | 204/47 |
| 3,677,909 | 7/1972 | Yamamura et al. | 204/43 N |

FOREIGN PATENTS OR APPLICATIONS

| | | | |
|---|---|---|---|
| 25,606 | 7/1971 | Japan | 204/43 N |

OTHER PUBLICATIONS

Frederick A. Lowenheim, "*Modern Electroplating*", p. 434, (1968).

*Primary Examiner*—G. L. Kaplan
*Attorney, Agent, or Firm*—Arthur E. Kluegel; B. F. Claeboe; Richard P. Mueller

[57] ABSTRACT

Disclosed is an aqueous plating bath suitable for obtaining electrodeposits of palladium and its alloys. The bath is substantially free of cyanide, nitrate and nitrite, and comprises sulfite ion, palladium in the form of a tetra-coordinated complex with palladium in the +2 oxidation state, an atomic ratio of halide to palladium not in excess of 10, and exhibits a pH of from 7 to 12.

7 Claims, No Drawings

PALLADIUM ELECTROPLATING BATH, PROCESS, AND PREPARATION

BACKGROUND OF THE INVENTION

The present invention concerns an electrolytic or galvanic sulfite containing bath, free from cyanide, for the electrodeposition of palladium and alloys thereof. The invention also concerns a process for the preparation and the replenishing of said electrolytic bath.

There exists already many electrolytic baths and methods for coating conductive pieces, or pieces made electrically conductive, with an electrolytic deposit of palladium or of alloys of palladium with precious or base metals. For the preparation of such baths, a great variety of salts have been employed and, more particularly, complexes the degree of coordination of which is often ill defined.

Thus, baths prepared from complex palladium cyanides have been used, e.g., $Pd(NH_3)_2(CN)_2$ (U.S. Pat. No. 1,991,995), from palladium nitrates in ammonia (*Electroplat. Met. Finishing* (1962) 15, 20) and from palladium and potassium nitrate (U.S. Pat. No. 1,993,623).

Halogenated derivatives have also been used for such baths, e.g., palladium tetrammine halides (German Pat. No. 1,262,722, Russian Pat. No. 280,153 and British Pat. No. 1,143,178) and palladium dichlorodiamine hydroxide (French Pat. No. 1,417,567).

Palladium nitrite baths are also known (*Metal Finishing Guidebood & Directory*, Westwood, N.J., USA, pp. 335–337), as well as those containing palladium tetrammine hydroxide (Russian Pat. No. 291,988 or complexes of palladium with organic compounds, e.g., palladium cyclohexanediamine tetraacetate, palladium ethylenediamine chloride and the corresponding sulfate (British Pat. No. 1,051,383) and salts of palladium and urea (German patent application No. 1,796,110).

The baths described above generally have a pH neutral or basic, acidic baths being apparently more difficult to control. However, a strongly acidic bath containing palladium nitrate and a small proportion (5 – 20%) of palladium sulfite has been recently disclosed (German patent application No. 2,105,626).

Although the baths described above have some advantages, they also have drawbacks. Thus, in general, palladium and palladium alloy deposits obtained from the known methods are subject to high internal stress which can result in the formation of splits and cracks when the thickness of the deposit is more than a certain critical value, e.g., 5 to 10$\mu$. Such deposits are also very porous.

Furthermore, the use of palladium nitrate or nitrite baths, particularly in the presence of sulfites and organic chelating agents or brighteners, sometimes results in some undesirable discoloring of the deposits.

Also, in halogen rich baths, free halogens are released at the anodes during electrolysis which oxidizes said anodes and shorten the useful life thereof.

Finally, it should be noted that the presence of cyanides in electrolytic baths is highly undesirable because of their inherent toxicity and the problems associated with the treatment of waste liquors.

SUMMARY OF THE INVENTION

The bath of the present invention is free from the above defects. It is a bath having a pH from 7 to 12 comprising practically no nitrates nor nitrites, wherein the palladium having an oxidation state of $^{+}2$, is in the form of tetracoordinated Pd ions, wherein the halogen ion (X) content is maintained at a low value such that the atomic ratio X/Pd is lower than 10.

DETAILED DESCRIPTION OF THE INVENTION

The process for the preparation of the electrolytic palladium and palladium alloy bath according to the present invention comprises for its make-up, dissolving in an aqueous basic solution of an alkali or ammonium sulfite, in addition to the conventional ingredients generally used in such kind of electrolytic baths, at least one palladium derivative selected from the compounds of formulae $$[PdX_{n-1}Y_{3-n}]ME_{n-1} \quad (I),$$
$$[PdZ_nY_{4-n}]ME_{2n-2} \quad (II),$$
$$[PdQ_nY_{4-n}]ME_{3n-2} \quad (III),$$

and the ion $$[PdY_4]^{+2} \quad (IV)$$

with counteranion X, Z or Q, these being mono-, di- and tri-valent anions respectively, wherein Y is the monocoordinative function of a mono- or polyfunctional coordination entity having zero electrovalence, ME is a monovalent cation or an $m^{th}$ fraction of a cation of a valence $m$, $n$ and $m$ being integers 1 to 3, and which comprises, for its replenishing, dissolving in the bath a derivative of formula $$[Pd(SO_3)_nY_{4-n}]ME_{2n-2} \quad (V)$$

wherein Y, ME and n are defined as above, so as to keep the molar atomic ratio halogen/palladium in the solution below 10.

The other metals which can provide deposits of palladium alloys by the electrolysis of the present bath are much varied. Practically, most common or base metals and precious metals are suitable. As such, the following can be mentioned: Cd, Cr, Co, Cu, Ga, Au, In, Fe, Pb, Mo, Ni, Ag, Sn, V, Zn. However, in special cases, it is also possible to incorporate in the present bath metals such as As, Sb and Bi or noble metals of the platinum group such as Pt, Rh, Ru, Ir and Os. These metals can be present in the bath in the form of their water soluble salts or complexes generally used in the electroplating art with the exception, naturally of nitrates and nitrites. Among the derivatives of said metals the following will be preferably used: salts, e.g., halides, sulfates, sulfites, phosphates, pyrophosphates, salts with organic acids, e.g., acetates, formates, or chelates with conventional chelatants, e.g., ethylene diamine (en), ethylenediamine tetraacetic acid (EDTA) and ethylenediamine tetramethanephosphonic acid (EDTP). It is clear that the kind of each of said different metal compounds must be chosen as a function of their mutual compatibility and solubility in the bath.

The present bath can naturally contain more than one of the above mentioned alloying metals such as to provide alloy deposits having 2, 3 or several metal components. The concentration of the palladium and of the other metals in the present bath will be dependent on different factors such as, for instance, operating condition of the bath: current density, temperature, degree of agitation, etc., and the properties to be imparted to the palladium or palladium alloy to be deposited: mechanical properties, physical aspect, grade, etc. Generally, the grade of an electrodeposited alloy depends on the relative proportions of the metal ions present in the bath. However, this relation does not follow a straight line since, for given concentrations it is possible to change the grade of the deposited alloy by modifying the conditions of electrolysis. As an example, it can be mentioned that when using a solution for the electrodeposition of Pd-Ni alloys containing equivalent concentration (by weight) of these two metals, it is possible, by suitably modifying the operating conditions, e.g., current density, to vary plus or minus 30% the grade of the deposited alloy the average composition of which is normally 50:50.

Generally, the concentration of the palladium and the alloying metals will be comprised between 1 and 50 g/l. However, these limits are not critical and, in some special cases, it will be possible to operate with concentrations below 1 g/l, e.g., from 1 to 1000 mg/l, or above 50 g/l, e.g., up to saturation.

In order to have the pH of the present bath adjusted between 7 and 12, as mentioned earlier, the bath can contain a basic compound, mineral or organic, for instance an alkali hydroxide (NaOH, KOH, LiOH, etc.) or ammonia. Using a quantity ranging from about 20 to 200 ml/l of 25% aqueous ammonia is preferred.

The amount of sulfite of the present bath may vary between wide limits. Indeed, at the beginning of its use, the bath can contain only relatively little sulfite, e.g., in the order of 1 to 10 g/l. As replenishing of the bath proceeds according to the present invention, the amount of sulfite will progressively increase without difficulty up to about 200 g/l or more. As sulfites, besides the sulfite of the alloying metals which are possibly present, the bath may contain alkali, earth-alkali or ammonium sulfites or the sulfite of organic bases.

The present bath can contain as the ingredients usually present in the electrolytic baths conducting and/or buffering agents, brighteners, complexing agents for controlling and inhibiting the deleterious effect of impurities which may be present in the bath, surfactants or wetting agents, etc. The purpose of the agents for controlling the effect of impurities is to block a significant amount thereof under a form which is electrochemically inactive during electrolysis for preventing such impurities to co-deposit with the coated metal and damage the aspect or the properties thereof.

The present bath can contain as conducting and/or buffering agents, besides the sulfites already mentioned and the alkali compounds necessary to adjust the pH between the above limits, one or several salts from mineral or organic acids with alkali, earth-alkali metals and ammonium, e.g., alkali halides (NaCl, $NH_4Br$, etc.), $Na_2SO_4$, $(NH_4)_2SO_4$, $(NH_4)_3PO_4$, $CH_3COONa$, sodium benzoate, etc. These agents are useful for increasing the conductivity of the bath and, if necessary, for preventing unexpected pH changes. The concentration of said conductivity and/or buffering agents can vary between 1 and 200 g/l but these limits are not critical. However, when using halides care must be taken that the molar ratio with the Pd does not go beyond the value indicated previously.

As brighteners and agents for controlling the impurities of the bath, conventional organic nitrogen, sulfur and phosphorous chelatants can be used. For example, compounds from the following classes can be used advantageously: arene- and alkane-sulfonic acids and the alkali and ammonium salts thereof, EDTA, diethylene triamine pentaacetic acid (DTPA) and its salts, the higher homologs thereof, their phosphorus analogs wherein the —COOH groups are replaced partially or totally by $—PO(OH)_3$ groups and their alkali or ammonium salts.

As examples of the above chelatants, the following compounds may be mentioned among others: $(HO)_2OP\text{-}COH(CH_3)\text{-}PO(OH)_2$; $(HO)_2P\text{-}CH_2\text{-}NH\text{-}CO\text{-}NH\text{-}CH_2\text{-}PO(OH)_2$; $(HO)_2OP\text{-}(CH_2)_n\text{-}PO(OH)$ with $n = 1$, 2 and 3; $N[CH_2\text{-}PO(OH_2]_3$;

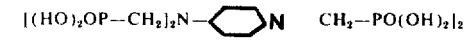

and other similar compounds.

The amounts of the above compounds which may be contained in the present bath strongly depend on the structure and the chelating action thereof. In some cases, very small quantities, e.g., below 1 g/l can be enough to counteract the effect of impurities and maintain the bath in proper operating conditions, in other cases, higher quantities may be necessary, for instance up to 10 or 20 g/l. However, in many cases, even an excess of such chelatants, for instance 50 g/l or more, is not pernicious, particularly if the metals of the alloy to be electrolytically deposited only have a weak affinity of such chelating agents. As an example, it may be mentioned that in the case of a palladium-nickel bath comprising, as chelating agent, ethylenediamine tetramethanephosphonic acid, a quantity of the latter in the range of, say, 1 to 100 g/l is convenient.

As wetting agents or surfactants, most compounds currently used in electrolytic baths can be used. A list of such compounds can be found in "Detergents & Emulsifiers, Allured Publ. Corp., Ridgewood, N.J., USA". Alkali sulfates and alkali alkanesulfonates are however preferred, e.g., sodium lauryl sulfate and alkali or ammonium methane-, ethane-, propane-, propene-, butane- or butene-sulfonates and the higher molecular weight homologs thereof.

In the above process for the preparation and maintenance of the above bath by means of compounds I, II, III, IV and V, X indicates a monovalent anion, e.g., $Cl^-$, $Br^-$, $I^-$, $CH_3COO^-$, $HO^-$, etc., Z designates bivalent anions, e.g., $SO_4^{-2}$, $SO_3^{-2}$, $[PdCl_4]^{-2}$, $SeO_4^{-2}$, etc. Q represents a trivalent anion such as $PO_3^{-3}$, $PO_4^{-3}$, etc. Y represents for example $H_2O$, $NH_3$ or an organic amine, namely $CH_3NH_2$, $(CH_3)_2NH$, $(CH_3)_3N$ or the N function of a di- or polyamine, e.g. $H_2N—CH_2—$ (of en) or

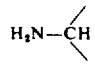

of cyclohexylamine or of cyclohexane diamine. It is evident that when said amine is a chelatant, i.e., when it comprises two coordination centers (or more), said centers can coordinate with one or more palladium atoms.

In the above formulae I to V, ME represents a mono- or polyvalent cation. As examples of such monovalent cations, one can mention alkali metal ions, $NH_4$ and complex groups, e.g., $[PdXY_3]^+$, where X and Y have the above mentioned meaning, such as $[PdCl(NH_3)_3]^+$. Other similar groups can be mentioned where the palladium is replaced by other transition metals (precious metals being included), e.g., Ni, Co, Cu, Fe, Au, Rn, Rh, etc.

As examples of divalent cations, one can mention earthalkali metals as far as the compounds involved are water-soluble and complex cations, for example, $[PdY_4]^{+2}$ wherein Y is also defined as above. Also in this case Pd can be replaced by other tetracoordinated metal atoms. Furthermore, divalent complex cations having a central atom with coordination number different from four are also possible, for example $[Co(NH_3)_6]^{+2}$.

As examples of trivalent cations, one can mention $Sb^{+3}$, $Cr^{+3}$, $Fe^{+3}$ and their complexes.

Preferably, the following compounds will be used for the initial preparation of the present bath: $[Pden(S_2O_3)_2]$ $(NH_4)_2$, $PdCl_2(NH_3)_2$, $[PdCl_4]$ $[Pd(NH_3)_4]$, $[PdCl_3NH_3]$ $[PdCl(NH_3)_3]$, $PdSO_3(H_2O)_3$, $K_2]Pd(SO_3)_2(H_2O)_2]$, $PdCl_2(OC(NH_2)_2)_2$, $[Pd(NH_3)_4]Cl_2$, $Na[ClPdSO_3en]$, $Pd(SO_3)$ $(NH_3)_3$ et $[Pd(SO_3)_2(NH_3)_2]$ $(NH_4)_2$.

A listing of palladium compounds which are suitable for carrying out the present invention and methods for the preparation of said compounds can be found in F. R. Hartley: *The Chemistry of Platinum and Palladium*, Applied Sc. Publ. Ltd., London (1973) and references included therein. See Also *J. Chem. Soc.* (1960), p. 2620.

For replenishing the present bath, $Pd(SO_3)$ $(NH_3)_3$ will preferably be used so as to keep the chloride content of the bath during the full useful life of the bath, i.e., for at least 40 to 50 replenishments, sufficiently low for ensuring that the chlorine evolution at the anode is negligible.

The present bath can be operated at temperatures comprised between about 20° and 80°C., preferably at 50°–60°C. The current density can be about 0.1 to 5 A/dm², preferably between 0.5 and 1.5 A/dm². However, the temperature and current density limits are not critical and can be exceeded in some special cases.

Preferably, the present palladium bath will be replenished when the initial Pd concentration has dropped 20 to 50%.

The following Examples illustrate the invention in more details. In said Examples the temperatures are given in degrees centigrade.

EXAMPLE 1

Bath for the Electrolytic Deposition of Palladium

An electrolytic solution was prepared by dissolving the following ingredients in water (the concentration of Pd is given in g of metal/liter):

| Ingredients | g/l or ml/l |
|---|---|
| Pd as $Pd(SO_3)$ $(NH_3)_3$ | 9 |
| $(NH_4)_2SO_3$ | 25 |
| $NH_4OH$ (aqueous, 25%) | 100 ml |
| $(NH_4)_2SO_4$ | 40 |
| Potassium salt of ethylene diamine tetra(methyl phosphonic acid) (30% $H_2O$)* | 15 ml |
| $NH_4Cl$ | 10 |
| 2-ethylhexyl NaSulfate (aqueous, 30%) | 0.5 ml |
| pH | 9.8 |

*Manufactured by Monsanto Co., St. Louis, Mo. 63166, USA — as DEQUEST 2044

The above bath was operated at 60°C. under 1 A/dm² which gave shiny grey cathode deposits thicker than 10μ without any visible cracks or faults.

When the Pd concentration of the bath had dropped to 4 g/l, the latter was replenished with $Pd(SO_3)$ $(NH_3)_3$. At least 40 successive replenishing steps were carried out without any loss in plating efficiency.

The palladium triammine sulfite used for the preparation of the above bath was prepared as follows:

Palladium dichloride (4 g = 2.356 g Pd) was suspended in water (50 ml). To this were added 2.588 g NaCl and the mixture was heated to 60°C. while stirring. The solids dissolved in about 30 minutes to give a deep red solution of $Na_2[PdCl_4]$. Still at the same temperature, 20–30 ml of 25% aqueous ammonia were added which resulted in the formation of a pink precipitate of $[Pd(NH_3)_4][PdCl_4]$. The product was not separated and the heating to 60°–80°C. was continued until $[PdCl(NH_3)_3]Cl$ was formed which finally turned to pale-yellow $[Pd(NH_3)_4]Cl_2$.

The clear yellow solution was cooled to 5°–10°C. and a solution of $(NH_4)_2SO_3.H_2O$ (3.1 g) in water (25 ml) was added dropwise. $PdSO_3(NH_3)_3$ (5.01 g, 94%) precipitated as fine colorless crystals which were separated by filtration and dried under reduced pressure. Elemental analysis confirmed the above formula for the product.

EXAMPLE 2

Bath for the Electrodeposition of Palladium-Nickel Alloy

The following ingredients were dissolved in water at the concentration given below (the concentration of the compounds of the metals deposited is given in g of metal/l):

| Ingredients | g/l (or ml/l) |
|---|---|
| Pd as $PdCl_2[OC(NH_2)_2]_2$ | 6 |
| Ni as $NiSO_4$ | 6 |
| $Na_2SO_3$ | 30 |
| $NH_4OH$ (25% in $H_2O$) to give pH 9.5–9.8 | 100–110 ml |
| $(NH_4)_2SO_4$ | 45 |
| DEQUEST 2044 | 25 |
| Anionic Surfactant (40% in $H_2O$)* | 0.5 ml |

*Manufactured by Du Pont Co., Wilmington, Del. 19898, USA — as ALKANOL 189S

The above bath was operated at 50°–60°C. under 1.5 A/dm² which gave a bright cathode alloy deposit of 50:50 palladium-nickel having high hardness (500 Vickers) and high ductility. It was possible to obtain with this bath crack-free deposits more than 50μ thick with yields of 25 mg/A.min.

When palladium and nickel content of the present bath had dropped about 20%, it was replenished with the correct amount of a 1:1 Pd-Ni mixture in the form of $Pd(NH_3)_3SO_3$ and $NiSO_4$.

The pieces coated with Pd-Ni deposits from the above bath (2 and 5μ thick) have been subjected to tests for checking their resistance to corrosion. Some of the control samples were palladium clad, the others coated with pure nickel, the thickness of the deposits being identical to those of the test samples.

1. Ammonia test — At room temperature, the pieces were hanged in a closed vessel filled with $NH_3$ over a saturated solution of $Na_2SO_3$.

After 48 hrs., it was noted that the pieces coated either with pure Pd or Ni showed corrosion signs whereas the pieces protected by the 50:50 Pd-Ni alloy were intact. After 11 days, the Pd and Ni coated controls were entirely corroded whereas the pieces coated with the 50:50 Pd-Ni alloy were only slightly attacked.

2. Thioacetamide test — As in the first step, the pieces were hanged in a shut vessel very close to solid powered thioacetamide and to a concentrated aqueous solution of sodium sulfite. After standing 5 days, the pieces covered either by Ni or Pd were strongly attacked whereas the test samples covered by the Pd-Ni alloy were only slightly attacked.

3. Artificial sweat test — A solution of artificial sweat (German Standards BAM) was prepared by mixing together the following ingredients (g/l):

| Ingredients | g/l |
|---|---|
| NaCl | 20.0 |
| $NH_4Cl$ | 17.5 |
| Urea | 5.0 |
| $CH_3COOH$ | 2.5 |
| $CH_3—CO—COOH$ | 2.5 |
| Butyric acid | 5.0 |
| Lactic acid | 15.0 |
| $H_2O$ to make | 1.0 liter |
| NaOH (aqueous sol.) to adjust pH to 4.7 | |

The pieces were placed on cotton pads soaked with the above solution and contained in an enclosure heated to 40°C. The temperature was thermostatically controlled. After 11 days standing under test conditions, the pieces coated with the Pd-Ni alloy were only slightly attacked whereas the control samples were strongly attacked.

EXAMPLE 3

Bath for the Electrodeposition of a Palladium-Copper Alloy

The following ingredients were dissolved in water at the concentrations below; the concentrations of the compounds of the metals forming the alloy are given in g of metal/l:

| Ingredients | g/l or ml/l |
|---|---|
| Pd as $PdSO_3(NH_3)_3$ | 5 |
| Cu as $CuSO_4$ | 0.5 |
| $(NH_4)_2SO_3$ | 50 |
| $Na_2SO_3$ | 30 |
| DEQUEST 2044 | 20 ml |
| Na and lauryl sulfate (30% $H_2O$ sol.) | 0.5 ml |
| pH adjusted with $NH_4OH$ | 9.5 |

The above bath was operated at 60°C. under 0.9–1 A/dm² which gave shiny grey-pink deposits, ductiles and having no cracks even when more than 10$\mu$ thick.

EXAMPLE 4

Bath for the Electrodeposition of a Palladium-Gold Alloy

The same procedure described in the previous Examples was followed by means of the following ingredients:

| Ingredients | g/l (or ml/l) |
|---|---|
| Au as $Au^{+1}$sulfite | 5 |
| Pd as $PdSO_3(NH_3)_3$ | 1 |
| $Na_2SO_3$ | 30 |
| $(NH_4)_2SO_4$ | 50 |
| DEQUEST 2044 | 20 ml |
| $As_2O_3$ (0.1% aqueous sol.) | 3 ml |
| Polyethylene glycol Na sulfate | 0.05 g |

The above bath was operated at 50°–60°C and 1 A/dm² which gave yellow-grey bright coatings the grade of which was (in respect to gold) 18–20 kt.

EXAMPLE 5

Bath for the Electrodeposition of a Palladium-Cobalt Alloy

The same procedure as for the previous Examples was followed by using the following ingredients:

| Ingredients | g/l or ml/l |
|---|---|
| Pd as $[Pd(NH_3)_4]Cl_2$ | 5 |
| Co as $CoSO_4$ | 5 |
| $Na_2SO_3$ | 30 |
| Sodium allylsulfonate (30% aqueous) | 1 ml |
| pH adjusted with $NH_4OH$ | 9.5 |

The above bath was operated as described in the previous Example (60°C. 1 A/dm²) and gave 50:50 Pd-Co shiny deposits, ductile, the properties of which were comparable to those of the Pd-Ni alloy previously described.

EXAMPLE 6

Bath for the electrodeposition of a Palladium-Cobalt Alloy

The procedure of Example 5 was followed except for the further addition of 20 ml/l of DEQUEST 2044 solution (see definition in Example 1). After this addition, the bath still performed as the bath of Example 5; it was, however, less sensitive to the presence of impurities and its useful life was prolonged.

EXAMPLE 7

Bath for the Electrodeposition of a Palladium-Zinc Alloy

The same procedure as for the previous Examples was followed by using the following ingredients:

| Ingredients | g/l (or ml/l) |
|---|---|
| Pd as $PdCl_2(NH_3)_2$ | 6.5 |
| Zn as $ZnSO_4$ | 6.0 |
| $(NH_4)_2SO_4$ | 50.0 |
| $(NH_4)_2SO_3$ | 40.0 |
| $OC[NH—CH_2—PO(OH)_2]_2$ | 2.0 |
| Dodecyl sodium sulfate (10% aqueous) | 1.5 ml |
| pH adjusted with $NH_4OH$ | 9.8 |

This bath was operated at 60°C. under 1 A/dm² and gave white, shiny deposits without cracks at least up to 5$\mu$ and having good resistance to corrosion. When necessary, the bath was replenished with $Pd(SO_3)_2(NH_3)_2Zn$.

EXAMPLE 8

Bath for the Electrodeposition of a Multicomponent Pd Alloy.

A bath containing the following ingredients dissolved in water was prepared. The concentration of the alloy metal compounds is given in g of metal/l.

| Ingredients | g/l or ml/l |
|---|---|
| Pd (as $PdCl_2[OC(NH_2)_2]_2$) | 5 |
| Ni (as $NiSO_4$) | 5 |
| Zn (as $ZnSO_4$) | 0.06 |

-continued

| Ingredients | g/l or ml/l |
|---|---|
| Cu (as $CuSO_4$) | 0.03 |
| $CH_3COONH_4$ | 50 |
| $Na_2SO_3$ | 25 |
| DEQUEST 2044* (30% aqueous) | 100 ml |
| $NH_4OH$ (25%) to give pH | 9.3-10 |

*Organophosphorus chelating agent from MONSANTO Co., St. Louis, Mo 63166, U.S.A.

The bath was operated at 50°-60°C and 1 A/dm². It gave 20μ white bright deposits having the following % composition: Pd 60, Ni 36, Zn 2, Cu 2.

Sample pieces having received a 5μ coating of the above alloy were subjected to the artificial sweat test of Example 2. After 20 days testing no change was observed.

We claim:

1. An aqueous electroplating bath suitable for obtaining deposits of palladium and its alloys wherein the palladium present consists essentially of a dissolved palladium complex of the formula $Pd(SO_3)(NH_3)_3$ in an amount from 1 g/l to 50 g/l of palladium, said bath exhibiting a pH of from 7 to 12.

2. The bath of claim 1 containing an atomic ratio of halide to palladium not in excess of 10.

3. The bath of claim 2 additionally comprising, in electrodepositable form, at least 1 mg/l of at least one metal selected from the group consisting of Cd, Cr, Co, Cu, Ga, Au, In, Fe, Pb, Mo, Ni, Ag, Sn, Zn, As, Sb, Bi, Pt, Rh, Ru, Ir and Os.

4. The bath of claim 1 containing between 1 g/l and 20° g/l of buffering or conductive salts selected from the alkali metal, earth-alkali metal and ammonium organic or mineral salts.

5. The bath of claim 1 additionally comprising an organo-nitrogen, -sulfur, or -phosphorus compound selected from the group consisting of polyamines, aryl and alkyl sulfonates, aryl and alkyl phosphonates, the alkali metal and ammonium salts and the —OH, —COOH, —CHO, and substituted or unsubstituted amino derivatives of the foregoing.

6. A method of obtaining a deposit of palladium or an alloy thereof on a conductive surface comprising electrolyzing the bath of claim 1 with said surface as cathode.

7. In a method for replenishing the palladium content of a halide containing aqueous bath for the electrodeposition of palladium or its alloys, the improvement comprising maintaining the atomic ratio of halide:palladium at a value not in excess of 10 by adding the palladium as the complex $Pd(SO_3)(NH_3)_3$.

* * * * *

UNITED STATES PATENT OFFICE

CERTIFICATE OF CORRECTION

PATENT NO. : 3,933,602

DATED : January 20, 1976

INVENTOR(S) : Rene Henzi and Andre Meyer and Pierre Lalanne

It is certified that error appears in the above-identified patent and that said Letters Patent are hereby corrected as shown below:

IN THE CLAIMS:

Claim 4, line 2, please delete 20°g/l and insert

--- 200 g/l ---.

Signed and Sealed this

Twenty-second Day of March 1977

[SEAL]

*Attest:*

RUTH C. MASON
*Attesting Officer*

C. MARSHALL DANN
*Commissioner of Patents and Trademarks*